US005299543A

United States Patent [19]

Taruya et al.

[11] Patent Number: 5,299,543

[45] Date of Patent: Apr. 5, 1994

[54] IGNITION DEVICE FOR AN INTERNAL COMBUSTION ENGINE

[75] Inventors: Masaaki Taruya; Mitsuru Koiwa, both of Himeji, Japan

[73] Assignee: Mitsubishi Denki Kabushiki Kaisha, Tokyo, Japan

[21] Appl. No.: 878,690

[22] Filed: May 5, 1992

[30] Foreign Application Priority Data

May 8, 1991 [JP] Japan ..... 3-102295

[51] Int. Cl.[5] ..... F02P 17/00

[52] U.S. Cl. ..... 123/479; 123/630; 123/644; 324/388

[58] Field of Search ..... 123/630, 643, 644, 479, 123/481, 198 F; 324/388

[56] References Cited

U.S. PATENT DOCUMENTS 4,930,481 6/1990 Fujimoto et al. ..... 123/479
5,060,623 10/1991 McCoy ..... 123/643
5,134,987 8/1992 Mayer et al. ..... 123/630

FOREIGN PATENT DOCUMENTS 3817920 12/1988 Fed. Rep. of Germany .
3841739 6/1990 Fed. Rep. of Germany .
4016307 11/1991 Fed. Rep. of Germany .
19962 2/1985 Japan .
64-19176 1/1989 Japan .
2172115 9/1986 United Kingdom .

*Primary Examiner*—Andrew M. Dolinar
*Attorney, Agent, or Firm*—Sughrue, Mion, Zinn, Macpeak and Seas

[57] ABSTRACT

An ignition device for a multi-cylinder engine includes a plurality of integral ignition device units 9A and 9B associated with respective cylinders. A single ignition detector circuit 8, inserted between the battery 1 and the primary coil of the ignition coil 5 of respective units 9A and 9B, generates an ignition confirmation signal upon detecting a current exceeding a predetermined level.

4 Claims, 4 Drawing Sheets

IGNITION DEVICE FOR AN INTERNAL COMBUSTION ENGINE

BACKGROUND OF THE INVENTION

This invention relates to ignition devices for internal combustion engines, and more particularly to ignition devices for multi-cylinder internal combustion engines which are provided with the function for detecting the operation of the ignition coils for the respective cylinders of the engine.

FIG. 3 is a circuit diagram showing a conventional ignition device for an internal combustion engine. In FIG. 3, a driver transistor 2 is coupled across a battery 1 via a resistor 3. A power transistor 4 in Darlington connection is driven by the output of the driver transistor 2. The ignition coil 5 has a primary coil coupled across the positive terminal of the battery 1 and the collector of the power transistor 4. The secondary coil of the ignition coil 5 is coupled to the ignition plug (not shown) via a distributor (not shown). A current detecting resistor 6 is coupled across the emitter of the power transistor 4 and the ground. In response to the voltage developed across the current detecting resistor 6, a current limiter circuit 7 controls the base current of the power transistor 4, and thereby limits the current flowing through the primary coil of the ignition coil 5. An ignition detector circuit 8 detects the voltage developed at the collector of the power transistor 4 upon interruption of the current flowing through the primary coil of the ignition coil 5, and generates an ignition confirmation signal. In the figure, the ignition device is enclosed within a dot-and-dash line box 9.

The operation of the conventional ignition device of FIG. 3 is as follows.

When the driver transistor 2 is turned off in response to an external signal, the power transistor 4 is turned on to let the current flow through the primary coil of the ignition coil 5. Under this circumstance, a voltage corresponding to the current flowing through the primary coil of the ignition coil 5 is developed across the current detecting resistor 6. This voltage developed across the current detecting resistor 6 is supplied to the current limiter circuit 7. In response to this voltage, the current limiter circuit 7 controls the base current of the power transistor 4, and thereby limits the current through the primary coil of the ignition coil 5 to a predetermined magnitude, such that the current through the primary coil of the ignition coil 5 is maintained at a constant level.

Then, when the driver transistor 2 is turned on by an ignition signal and the power transistor 4 is turned off to interrupt the current through the primary coil of the ignition coil 5, a high voltage is developed across the secondary coil of the ignition coil 5 and is supplied to the ignition plug of the engine via the distributor.

The ignition detector circuit 8 detects the voltage developed at the collector of the power transistor 4 upon interruption of the current flowing through the primary coil of the ignition coil 5. When the detected voltage exceeds a predetermined level, the ignition detector circuit 8 generates an ignition confirmation signal. The ignition confirmation signal is supplied to a computer (not shown), such that the computer may judge whether or not the ignition coil is functioning properly. The computer determines to which cylinder of the engine the malfunctioning ignition coil corresponds, and the fuel supply to the malfunctioning cylinder is stopped in a fuel equalization system.

FIG. 4 is a circuit diagram showing another conventional ignition device for an internal combustion engine. The detector input of the ignition detector circuit 8 is coupled to the current detecting resistor 6, such that the voltage corresponding to the current flowing through the primary coil of the ignition coil 5 can be detected. Thus, the ignition detector circuit 8 detects the voltage developed across the current detecting resistor 6 corresponding to the current flowing through the primary coil of the ignition coil 5, and generates an ignition confirmation signal when the detected current level exceeds a predetermined level. Otherwise the circuit of FIG. 4 is similar to that of FIG. 3.

The above conventional ignition devices, however, have the following disadvantage. When a plurality of ignition device units are provided for respective cylinders of a multi-cylinder and the ignition coil and the power transistor of each unit are assembled into an integral unit, separate ignition detector circuits must be provided for respective cylinders. Thus, the circuit becomes complicated and expensive.

SUMMARY OF THE INVENTION

It is therefore an object of this invention to provide an ignition device for a simple and inexpensive multi-cylinder internal combustion engine which is capable of detecting the functioning states of the respective ignition coils provided for respective cylinders.

The above object is accomplished in accordance with the principle of this invention by an ignition device for a multi-cylinder internal combustion engine which includes: a current source means; a plurality of integrally assembled ignition device units each including an ignition coil coupled to the current source means and a power transistor for turning on and off a current flowing from the current source means and through a primary coil of the ignition coil, wherein the ignition coil of respective ignition device units is coupled to the current source means via a common current supply line; and a single ignition detector circuit inserted in the common current supply line between the current source means and the ignition coil of the plurality of ignition device units, the ignition detector circuit detecting the current flowing through the ignition coil of respective ignition device units from the current source means. The ignition detector circuit generates an ignition confirmation signal upon detecting a current exceeding a predetermined level.

Alternatively, the single ignition detector circuit may have detector inputs each coupled to a junction point between the ignition coil and power transistor of the respective ignition device units, the ignition detector circuit detecting voltage developed at respective junction points upon interruption of the current flowing through the primary coil of the ignition coil of respective ignition device units from the current source means. The ignition detector circuit generates an ignition confirmation signal upon detecting a voltage exceeding a predetermined level.

BRIEF DESCRIPTION OF THE DRAWINGS

The features which are believed to be characteristic of this invention are set forth with particularity in the appended claims. The structure and method of operation of this invention itself, however, will be best understood from the following detailed description, taken in conjunction with the accompanying drawings, in which:

In the drawings, like reference numerals represent like or corresponding parts or portions.

DETAILED DESCRIPTION OF THE PREFERRED EMBODIMENTS

Referring now to the accompanying drawings, the preferred embodiments of this invention are described.

Figure 1:
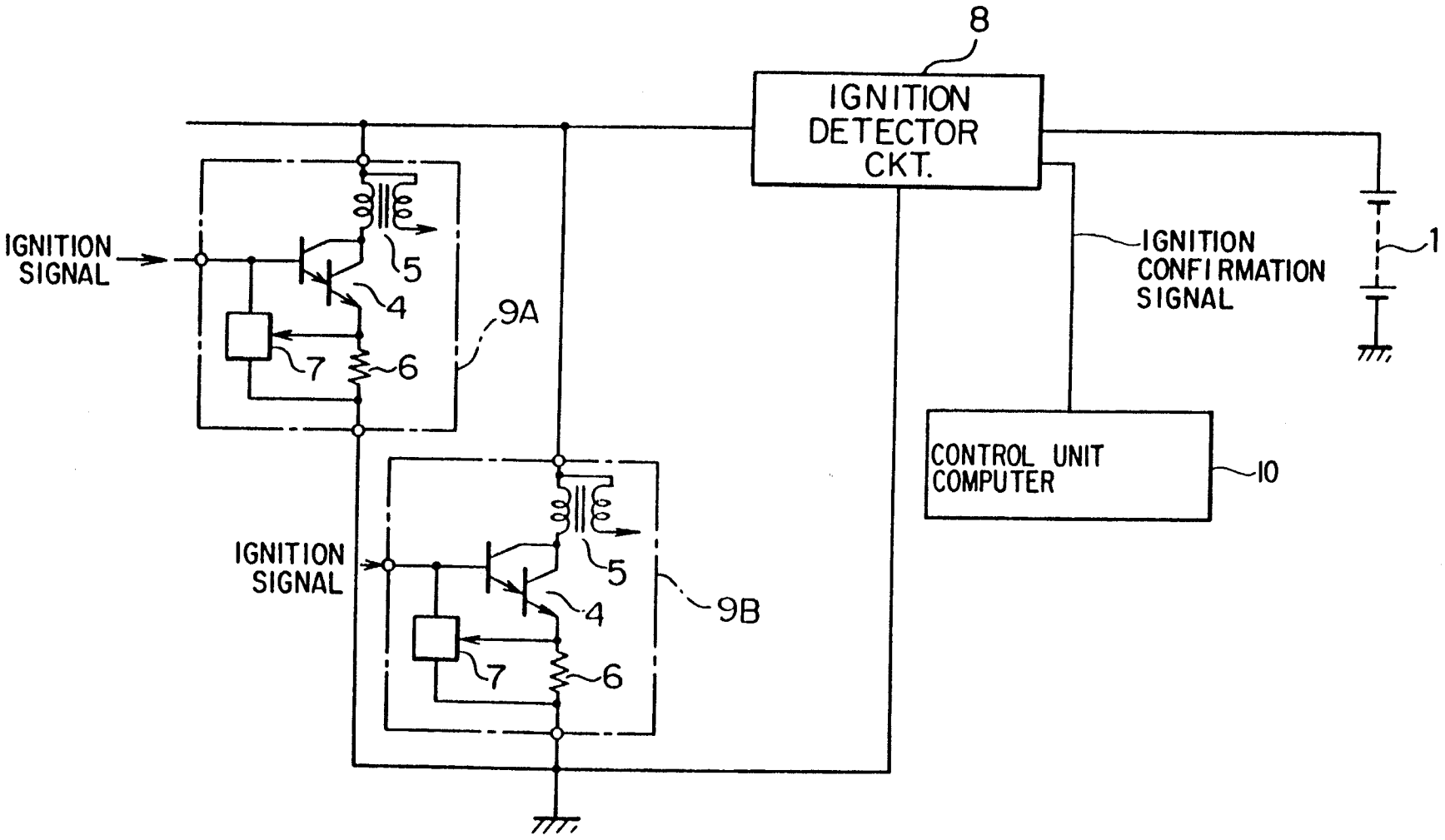
FIG. 1 is a circuit diagram showing an ignition device for a multi-cylinder internal combustion engine according to this invention.

FIG. 1 is a circuit diagram showing an ignition device for a multi-cylinder internal combustion engine according to this invention. The circuit includes a plurality of integrally assembled ignition device units provided for respective cylinders of the engine. FIG. 1 shows two ignition device units 9A and 9B. However, the circuit may include four ignition device units for a four-cylinder engine.

Figure 3:
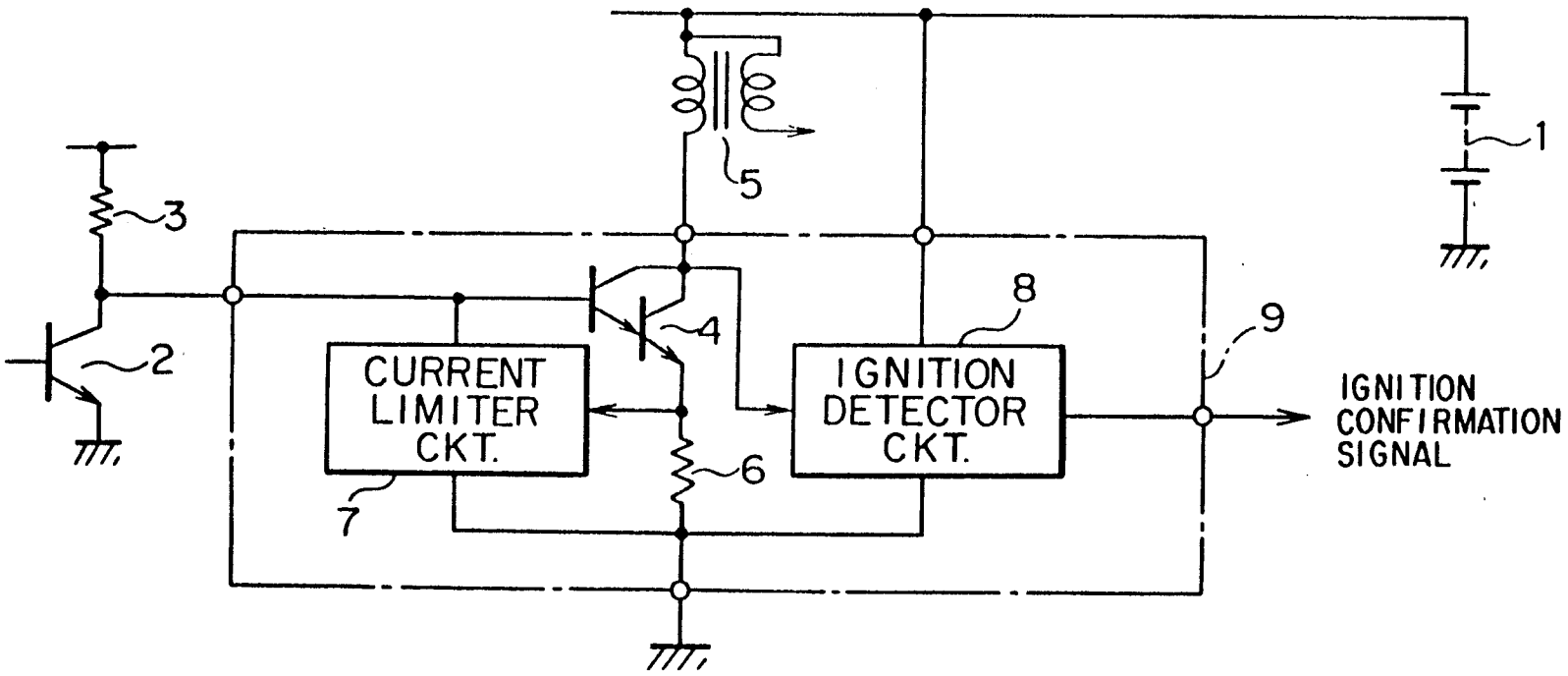
FIG. 3 PRIOR ART
FIG. 3 is a circuit diagram showing a conventional ignition device for an internal combustion engine.
Figure 4:
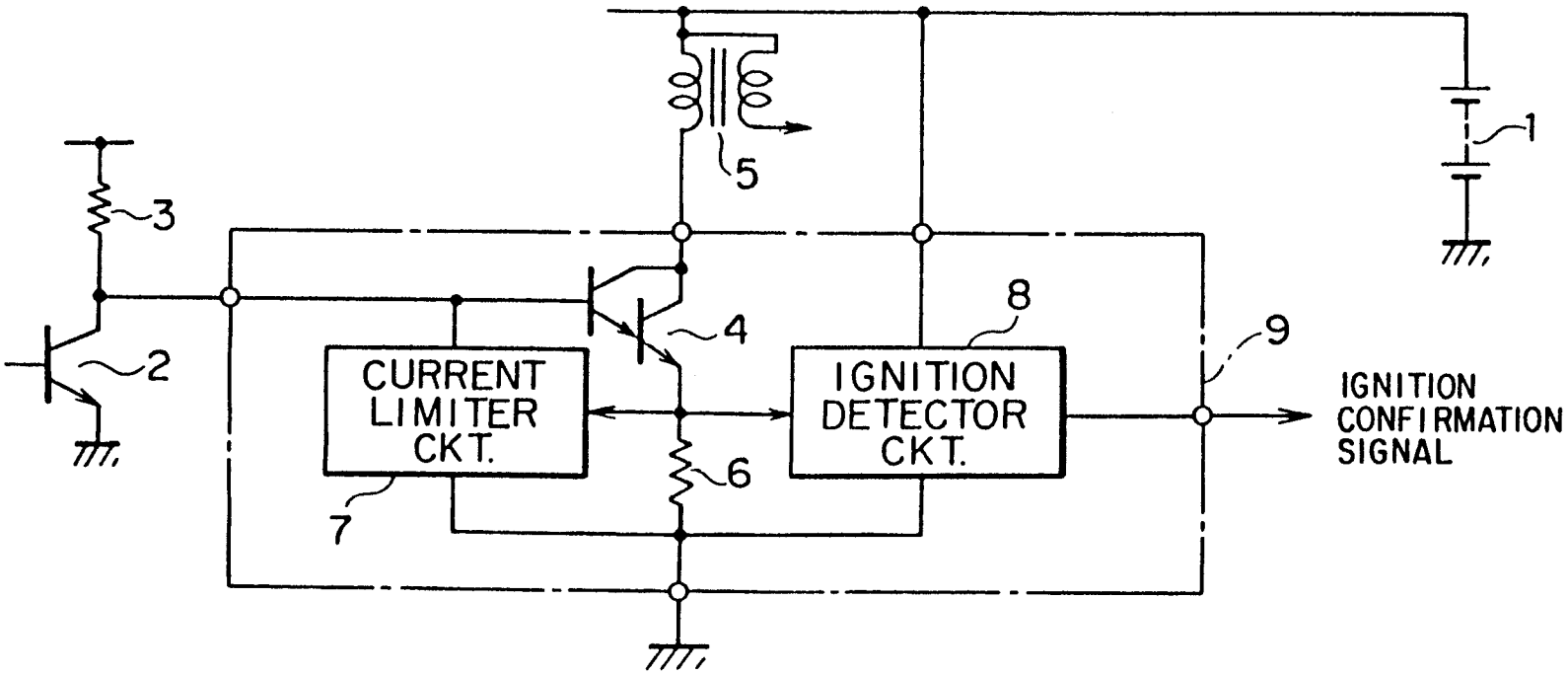
FIG. 4 PRIOR ART
FIG. 4 is a circuit diagram showing another conventional ignition device for an internal combustion engine.

Each one of the integral ignition device units 9A and 9B includes a power transistor 4 in Darlington connection, an ignition coil 5, a current detecting resistor 6 and a current limiter circuit 7. The parts 4 through 7 are similar to those of FIGS. 3 and 4. Thus, in each of the ignition device units 9A and 9B, the serial circuit consisting of the primary coil of the ignition coil 5, the power transistor 4, and the current detecting resistor 6 is coupled across the positive terminal of the battery 1 and the ground. The current limiter circuit 7, coupled across the base of the power transistor 4 and the ground, has a detector input terminal coupled to the junction point between the power transistor 4 and the current detecting resistor 6. The current limiter circuit 7 thus detects the voltage developed across the current detecting resistor 6.

An ignition detector circuit 8, having a grounded terminal, is inserted in the common current supply line supplying current from the battery 1 to the respective ignition coils 5 of the ignition device units 9A and 9B (that is, the ignition detector circuit 8 is inserted between the positive terminal of the battery 1 and the junction point at which the positive sides of the ignition coils 5 of the respective ignition device units 9A and 9B meet), such that the ignition detector circuit 8 is in serial circuit relationship with the primary coil of each ignition coil 5. The ignition detector circuit 8 thus detects the current flowing from the battery 1 and through the primary coil of the ignition coil 5 of the respective ignition device units 9A and 9B.

Next, the operation of the circuit of FIG. 1 is described. The plurality of ignition device units 9A and 9B correspond to and associated with respective cylinders of a multi-cylinder engine. The secondary coil of the ignition coil 5 of respective ignition device units supplies an ignition voltage to the ignition plug of the corresponding cylinder. An ignition signal is supplied from a control unit (not shown) to each ignition device unit at the ignition timing of the corresponding cylinder.

Thus, the ignition device unit 9A, for example, operates as follows. At a predetermined crankshaft angle before the ignition timing of the cylinder associated with the ignition device unit 9A, a current supply signal (high level voltage) is supplied to the base of the power transistor 4 and turns on the power transistor 4, such that a current from the battery 1 flows through the primary coil of the ignition coil 5 via the ignition detector circuit 8. The voltage developed across the current detecting resistor 6 due to the current flowing through the primary coil of the ignition coil 5 is detected by the current limiter circuit 7. The current limiter circuit 7 controls the base current of the power transistor 4 in accordance with the detected voltage, and thereby limits the current flowing through the primary coil of the ignition coil 5 to a predetermined level, such that the current through the primary coil of the ignition coil 5 is maintained to the predetermined level.

Under this circumstance, the ignition detector circuit 8 detects the current flowing through the primary coil of the ignition coil 5 and generates an ignition confirmation signal upon detecting a current exceeding a predetermined level. The ignition confirmation signal is supplied to the computer 10 of the control unit.

At the ignition timing of the cylinder associated with the ignition device unit 9A, an ignition signal (low level voltage) is supplied to the base of the power transistor 4 to turn it off and thereby interrupt the current flowing through the primary coil of the ignition coil 5. Upon interruption of the current through the primary coil of the ignition coil 5, a high ignition voltage is generated across the secondary coil of the ignition coil 5. This high ignition voltage is supplied to the ignition plug of the associated cylinder such that the cylinder is ignited at the proper ignition timing. The operation of the other ignition device unit 9B is similar to that of the unit 9A.

Thus, the computer 10 of the control unit is supplied with the ignition confirmation signal of the respective ignition device units 9A and 9B. Thus, the computer judges whether or not the ignition coil of the respective ignition device units is functioning properly. By comparing the generation timings of the respective ignition confirmation signal with the ignition timings of respective cylinders, the computer determines to which cylinder each ignition confirmation signal corresponds. The supply of fuel to the cylinder associated with a malfunctioning ignition coil, for which the ignition confirmation signal is not generated, is stopped in a fuel equalization system.

Figure 2:
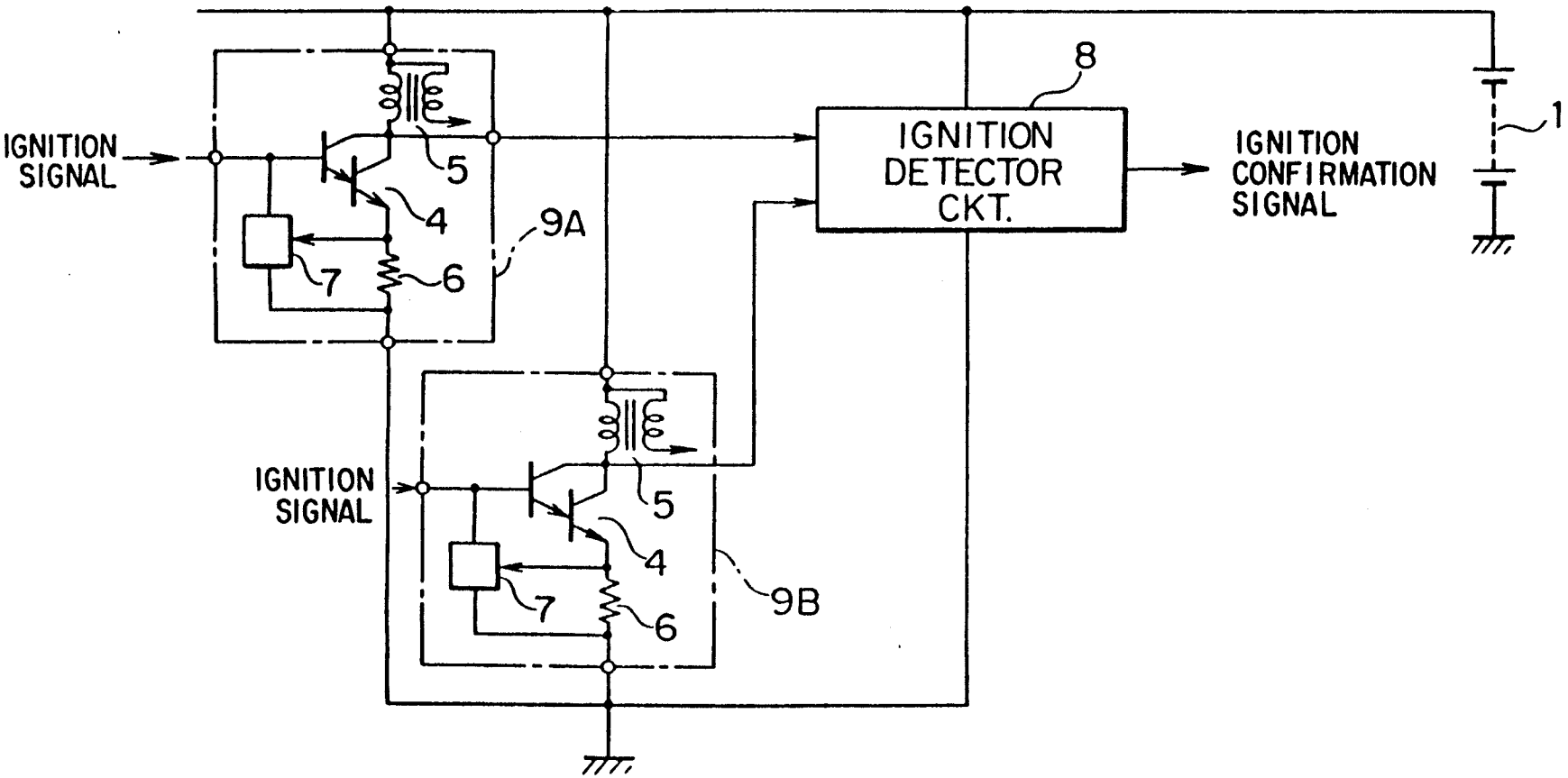
FIG. 2 is a circuit diagram showing another ignition device for a multi-cylinder internal combustion engine according to this invention.

FIG. 2 is a circuit diagram showing another ignition device for a multi-cylinder internal combustion engine according to this invention. The circuit of FIG. 2 is similar to that of FIG. 1, except that the ignition detector circuit 8, coupled across the positive terminal of the battery 1 and the ground, has detector inputs each coupled to the collector of the power transistor 4 (i.e., the junction point between the primary coil of the ignition coil 5 and the power transistor 4) of respective ignition device units 9A and 9B. Thus, the ignition detector circuit 8 detects the voltage developed at the collector of the power transistor 4 of respective ignition device units upon interruption of the current flowing through the primary coil of the ignition coil 5. When the detected voltage exceeds a predetermined level, the ignition detector circuit 8 generates an ignition confirmation signal, which is supplied to the computer of the control unit (not shown). The computer thus judges which one of the ignition coils are malfunctioning, and stops the fuel supply to the cylinder corresponding to the malfunctioning ignition coil. Otherwise, the structure and operation of the circuit of FIG. 2 is similar to those of the circuit of FIG. 1.

What is claimed is:

1. An ignition device for a multi-cylinder internal combustion engine, comprising:

a current source;

a plurality of integrally assembled ignition device units each including an ignition coil coupled to said current source and a power transistor for turning on and off a current flowing from said current source and through a primary coil of said ignition coil, wherein each of said ignition coils is coupled to said current source via a common current supply line; and a single ignition detector circuit, inserted in said common current supply line between said current source and said ignition coils for detecting malfunctions in said ignition coils by detecting said current flowing through each of said ignition coils from said current source, said ignition detector circuit identifying a malfunction by generating an ignition confirmation signal when a detected current exceeds a predetermined level.

2. An ignition device according to claim 1, wherein said single ignition detector circuit outputs said ignition confirmation signal only when one or more of said ignition coils malfunctions.

3. An ignition device according to claim 1, further comprising computer means for identifying which one of said ignition coils is malfunctioning based on said ignition confirmation signal and an ignition timing of said multi-cylinder internal combustion engine.

4. An ignition device according to claim 1, further comprising:

computer means for stopping a supply of fuel to one cylinder in said engine when said ignition detector circuit outputs said ignition confirmation signal identifying a malfunction in an ignition coil corresponding to said one cylinder.

* * * * *